US008402932B2

(12) United States Patent
Park

(10) Patent No.: US 8,402,932 B2
(45) Date of Patent: Mar. 26, 2013

(54) CONTINUOUSLY VARIABLE VALVE ACTUATION SYSTEM

(75) Inventor: Byung Ok Park, Whasung-si (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 393 days.

(21) Appl. No.: 12/504,096

(22) Filed: Jul. 16, 2009

(65) Prior Publication Data

US 2010/0139587 A1 Jun. 10, 2010

(30) Foreign Application Priority Data

Dec. 5, 2008 (KR) ..... 10-2008-0123653

(51) Int. Cl.
*F01L 1/34* (2006.01)

(52) U.S. Cl. ..... 123/90.16

(58) Field of Classification Search ..... 123/90.15, 123/90.16

See application file for complete search history.

(56) References Cited

U.S. PATENT DOCUMENTS

| | | | | |
|---|---|---|---|---|
| 7,451,729 | B2 * | 11/2008 | Sugiura et al. | 123/90.16 |
| 7,469,669 | B2 | 12/2008 | Fujita et al. | |
| 7,621,242 | B2 * | 11/2009 | Kitagawa et al. | 123/90.16 |
| 7,640,900 | B2 * | 1/2010 | Tateno et al. | 123/90.16 |
| 7,644,689 | B2 * | 1/2010 | Tateno et al. | 123/90.16 |
| 2009/0241874 | A1 * | 10/2009 | Lee | 123/90.16 |
| 2009/0293824 | A1 * | 12/2009 | Hwang | 123/90.16 |

FOREIGN PATENT DOCUMENTS

| | | | |
|---|---|---|---|
| JP | 10-212913 | A | 8/1998 |
| JP | 11-210416 | A | 8/1999 |
| JP | 2002-371819 | A | 12/2002 |
| JP | 2004-036524 | A | 2/2004 |
| JP | 2004-108302 | A | 4/2004 |
| JP | 2005-201149 | A | 7/2005 |
| JP | 2006-70725 | A | 3/2006 |

* cited by examiner

*Primary Examiner* — Thomas Denion
*Assistant Examiner* — Daniel Bernstein
(74) *Attorney, Agent, or Firm* — Morgan, Lewis & Bockius LLP

(57) ABSTRACT

A continuously variable valve actuation (CVVA) system may include a driving cam firmly fixed to a crank shaft and rotated by a driving force of the crank shaft, a driven cam configured to rotatably contact the driving cam, wherein the driven cam is selectively pressed by the driving cam to rotate around one end thereof serving as a rotational axle and has a cam face at the other end thereof so as to press and open a valve when pressed, and a swing arm, one end of which is pivotally coupled to a stationary member and the other end of which is coupled to the one end of the driven cam to be rotated around the rotational axle of the swing arm.

11 Claims, 8 Drawing Sheets

CONTINUOUSLY VARIABLE VALVE ACTUATION SYSTEM

The present application claims benefit to Korean Patent Application Number 2008-0123653 filed on Dec. 5, 2008, the entire contents of which application is incorporated herein for all purpose by this reference.

BACKGROUND OF THE INVENTION

1. Field of the Invention

The present invention relates to continuously variable valve actuation (CVVA) system and, more particularly, to a CVVA system in which the lift time, the lift distance and the duration of a valve can be simultaneously varied depending on various conditions of an engine, particularly the low-speed/high-speed operating range of an engine.

2. Description of Related Art

As for an engine, a camshaft is rotated by a rotating force transmitted from a crank shaft, and an intake valve and an exhaust valve are reciprocated up and down with regular timing by drive cams of the camshaft. Thereby, intake air is supplied to a combustion chamber, and combustion gas is exhausted. In this process, a fuel-air mixture is compressed and exploded to generate power.

At this time, a mechanism that can continuously vary the lift distance of a valve according to an operating speed of the engine is called a continuously variable valve actuation (CVVA) system.

Hereinafter, a conventional CVVA system will be described in detail with reference to the attached drawings.

FIG. 1 schematically illustrates the configuration of a conventional CVVA system.

Referring to FIG. 1, the conventional CVVA system includes a driving cam 4 installed on a camshaft 2, a swing arm 12 swinging in contact with the driving cam 4, a driving arm 19 driving a valve 5 in cooperation with the swing arm 12, a variable arm 13 causing the driving arm 19 to be pivoted around a swing axle of the swing arm 12, an actuator driving the variable arm 13, and a cam means installed between the swing arm 12 and the driving arm 19.

The swing arm 12 and the variable arm 13 are supported on a common control shaft 10 so as to allow relative motion. The driving arm 19 is connected to the variable arm 13 at a base end thereof, and has a driving portion 20 driving a rocker arm 6 at a leading end thereof. Further, the cam means includes a cam face 15 formed on the swing arm 12, and a cam follower 22 supported on an intermediate portion of the driving arm 19, and is configured to change an initial position of the driving arm 19 with respect to the swing arm 12 by pivoting of the driving arm 19.

According to the aforementioned configuration of the conventional CVVA system, when the driving cam 4 is rotated in a counterclockwise direction from the position illustrated in FIG. 1, the end (particularly, the right-hand end) of the swing arm 12 is rotated so as to move toward the driving arm 19 (see FIG. 1). When the end of the swing arm 12 comes into contact with the driving arm 19, the rocker arm 6 is pressed, and thus the valve 5 is opened.

At this time, when the variable arm 13 is rotated in a counterclockwise direction from the position illustrated in FIG. 1, the intermediate portion of the driving arm 19 comes into contact with the rocker arm 6, and thus gets near the end of the swing arm 12. In this state, when the driving cam 4 is rotated, the end of the swing arm 12 presses the driving arm 19 earlier, so that the valve 5 has an earlier lift time and thus a longer lift distance.

Thus, the conventional CVVA system as illustrated in FIG. 1 has an advantage in that the lift time and distance of the valve 5 can be regulated to the speed of an engine.

However, the conventional CVVA system is essentially equipped with various constituent parts such as a swing arm 12, a driving arm 19, a variable arm, an actuator 11, etc. in order to transmit the force of the driving cam 4 to the valve 5, so that it has a complicated configuration and a high cost of production.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY OF THE INVENTION

Various aspects of the present invention are directed to provide a continuously variable valve actuation (CVVA) system, which can vary lift time and distance of a valve at the same time, and simplifies a structure.

In an aspect of the present invention, the continuously variable valve actuation may include a driving cam firmly fixed to a crank shaft and rotated by a driving force of the crank shaft, a driven cam configured to rotatably contact the driving cam, wherein the driven cam is selectively pressed by the driving cam to rotate around one end thereof serving as a rotational axle and has a cam face at the other end thereof so as to press and open a valve when pressed, and a swing arm, one end of which is pivotally coupled to a stationary member and the other end of which is coupled to the one end of the driven cam to be rotated around the rotational axle of the swing arm.

A contact portion between the driving cam and the driven cam may be disposed between the one end and the other end of the swing arm.

The one end of the swing arm may be connected to a driving device so as to control a rotation angle of the swing arm with respect to the one end thereof.

In another aspect of the present invention, the cam face may include a high lift section where the driven cam allows the valve to move more than a set distance when rotated around the one end thereof, and a low lift section where the driven cam allows the valve to move less than a set distance when rotated around the one end thereof wherein the high lift section has a center formed at a position farther from the one end of the driven cam than a center of the low lift section.

In further another aspect of the present invention, the continuously variable valve actuation may further include an actuating shaft, which regulates a height of the one end of the driven cam such that the cam face contacted with the valve is limited between the high lift section and the low lift section regardless of a rotational angle of the driven cam, wherein the actuating shaft includes a pressing nose, which is configured to be contacted with a lower face of the other end of the swing arm and rotates the other end of the swing arm by rotating the actuating shaft and wherein the pressing nose is downwardly curved.

The stationary member may be a bracket, which rotatably supports the one end of the swing arm.

The driven cam may include a roller at a portion contacting the driving cam.

The cam face may have a shape of a downwardly curved surface, and the valve has a shape of an upwardly curved surface at a portion contacting the cam face.

The methods and apparatuses of the present invention have other features and advantages which will be apparent from or are set forth in more detail in the accompanying drawings, which are incorporated herein, and the following Detailed Description of the Invention, which together serve to explain certain principles of the present invention.

DETAILED DESCRIPTION OF THE INVENTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention (s) is/are intended to cover not only the exemplary embodiments, but also various alternatives, modifications, equivalents and other embodiments, which may be included within the spirit and scope of the invention as defined by the appended claims.

Figure 2:
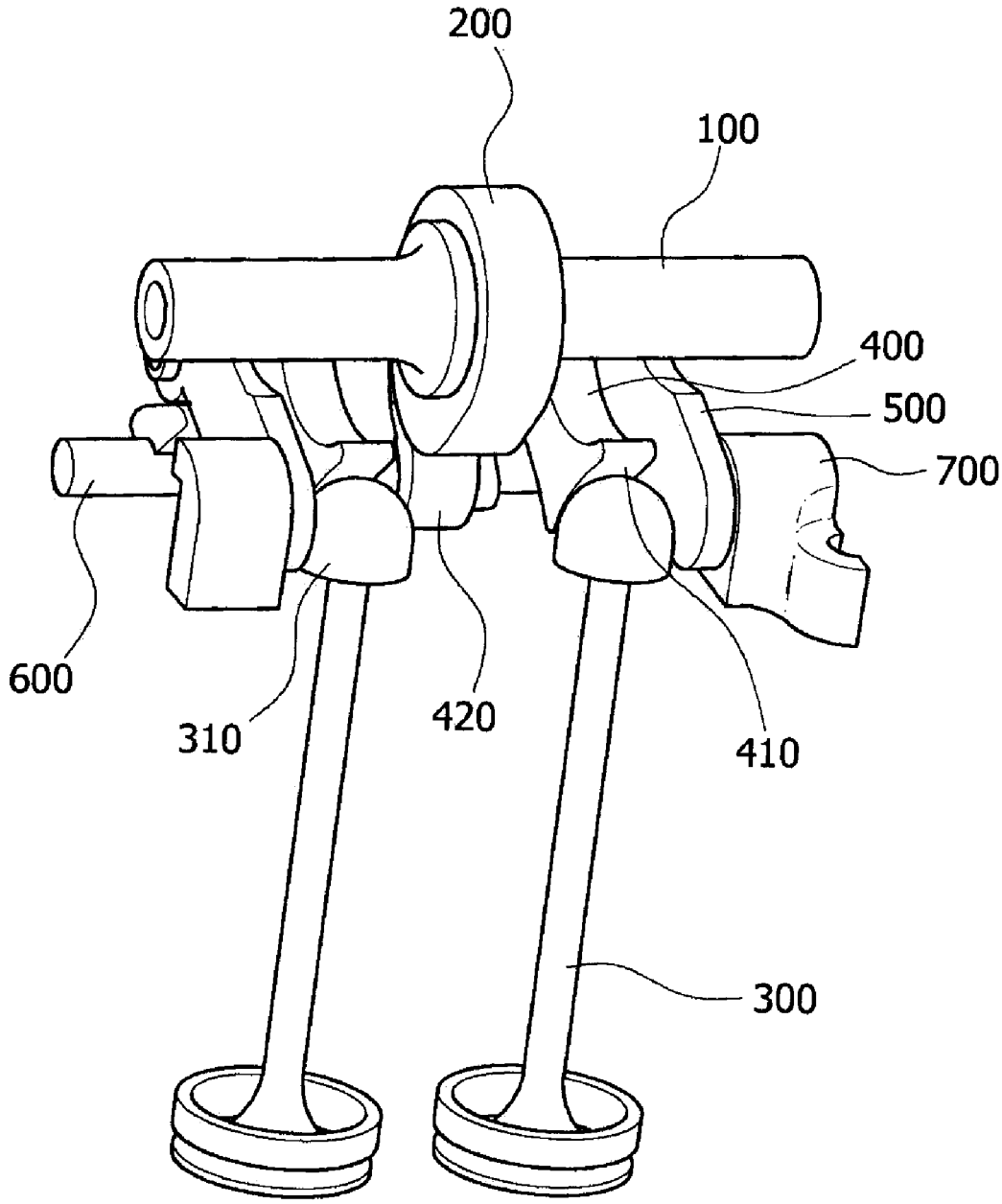
FIG. 2 is a perspective view illustrating an exemplary CVVA system according to the present invention.
Figure 3:
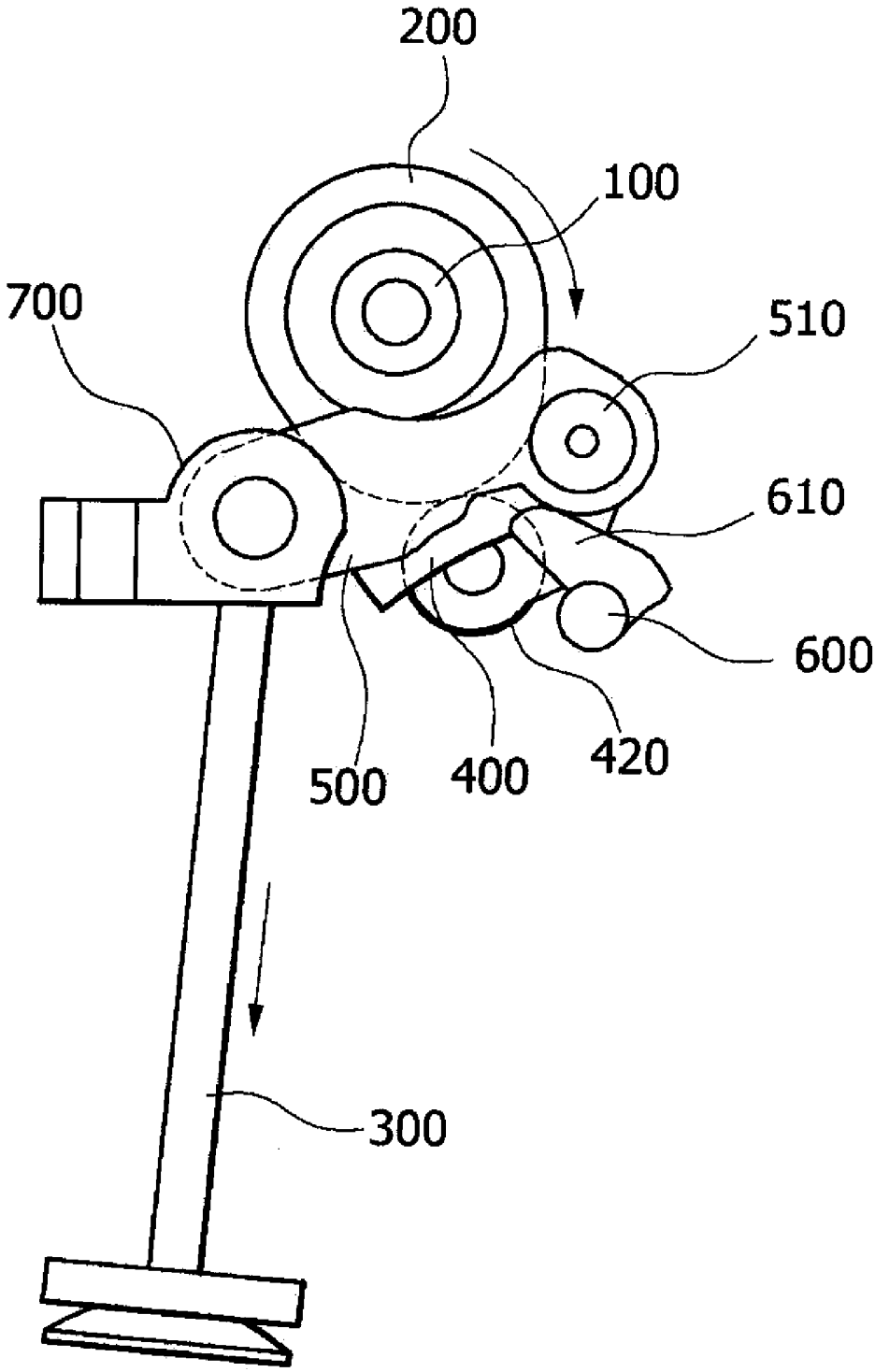
FIG. 3 is a side view illustrating an exemplary CVVA system according to the present invention.
Figure 4:
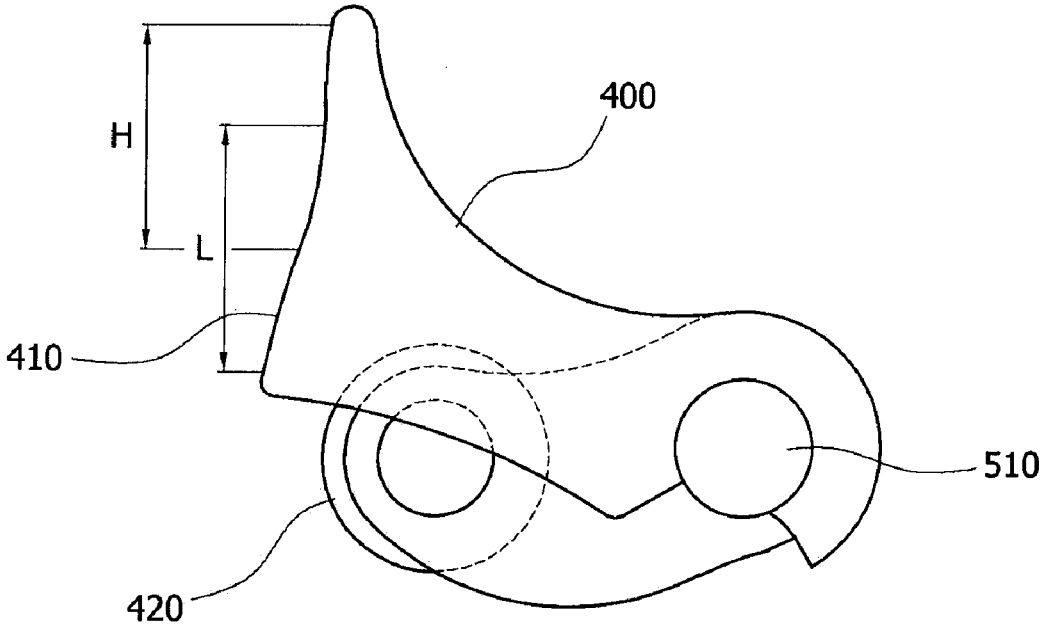
FIG. 4 is a side view illustrating the driven cam of an exemplary CVVA system according to the present invention.

FIG. 2 is a perspective view illustrating a continuously variable valve actuation (CVVA) system according to various embodiments of the present invention. FIG. 3 is a side view illustrating a CVVA system according to various embodiments of the present invention. FIG. 4 is a side view illustrating the driven cam of a CVVA system according to various embodiments of the present invention.

According to various embodiments of the present invention, the CVVA system includes a driving cam 200 rotated by a driving force transmitted from a crank shaft 100, a driven cam 400 pressed by the driving cam 200 and rotated around one end thereof serving as a rotational axle, wherein the driven cam 400 has a cam face 410 at the other end thereof so as to press and open a valve 300 when rotated, and a swing arm 500 coupled to the rotational axle of the driven cam 400 at one end thereof serving as a hinge axle 510 so as to be rotated around the other end thereof. Here, the rotational center of the swing arm 500 is invariable, while the rotational center, i.e. the hinge axle 510, of the driven cam 400 is variable according to the rotation of the swing arm 500.

Thus, as illustrated in FIG. 3, when the crank shaft 100 and the driving cam 200 coupled to the crank shaft 100 are rotated in a clockwise direction, a lobe of the driving cam 200 comes into contact with the driven cam 400, the driven cam 400 is rotated around one end thereof (right-hand side of FIG. 3), serving as a rotational axle, in a counterclockwise direction, and the cam face 410 of the driven cam 400 which is located at the other end thereof (left-hand side of FIG. 3) slides on a top surface of the contact block 310, and thus lowers a contact block 310 provided to an upper end of the valve 300. As the contact block 310 is lowered, the valve 300 is opened.

At this time, the driven cam 400 serves to regulate a lift distance of the valve 300 (i.e. a distance by which the valve 300 is pushed in a downward direction when opened) and a lift time of the valve 300 according to a position of the rotational axle thereof, and to directly press the upper end of the valve 300 in a downward direction when pivoted by the driving cam 200 to thereby open the valve 300.

Figure 1:
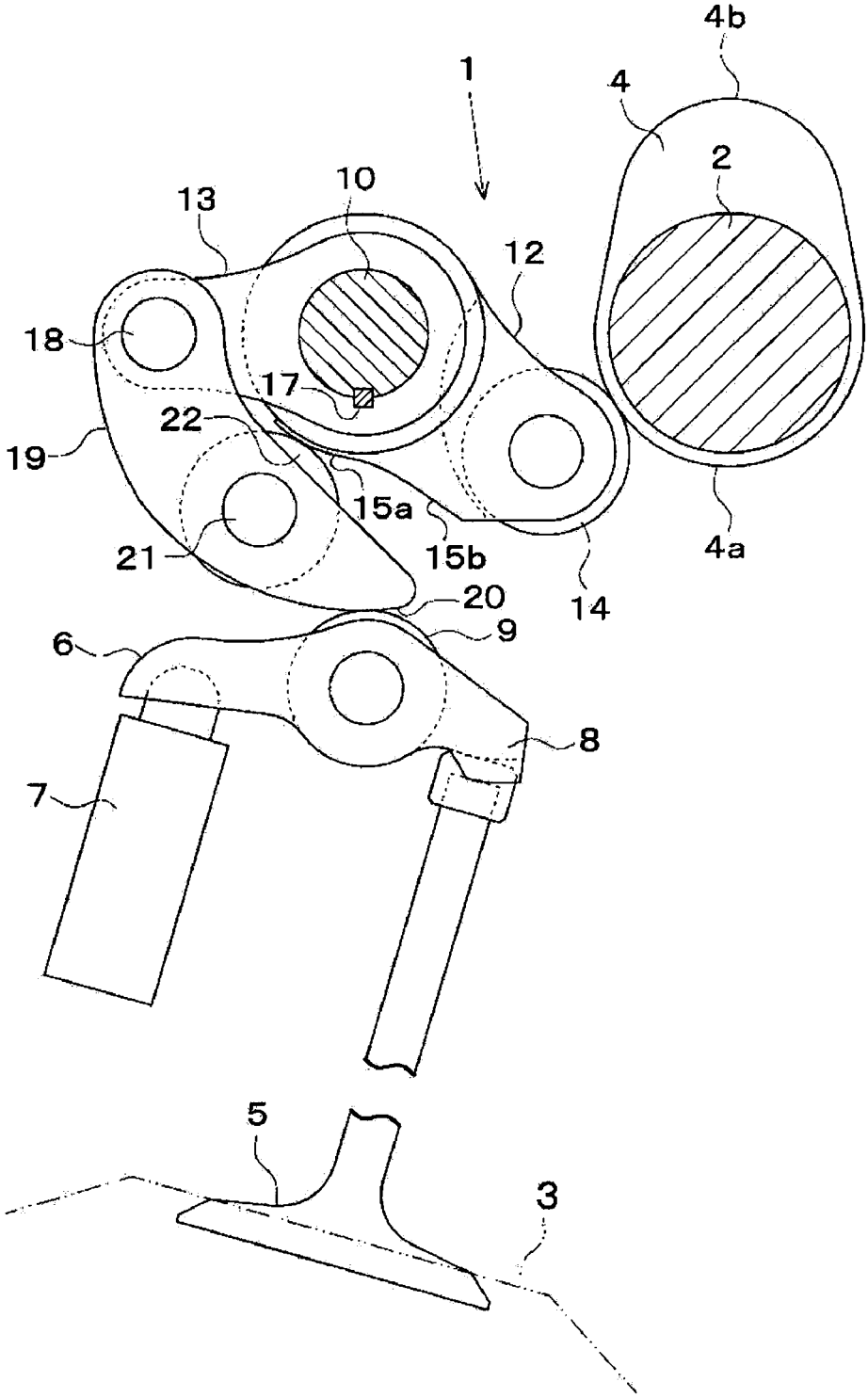
FIG. 1 PRIOR ART
FIG. 1 schematically illustrates the configuration of a conventional continuously variable valve actuation (CVVA) system.

In detail, the conventional CVVA system as illustrated in FIG. 1 is configured so that a driving force of the driving cam 4 is transmitted to the valve 5 through the swing arm 12, variable arm 13, driving arm 19 and rocker arm 6 in turn. In contrast, the CVVA system according to various embodiments is configured so that a driving force of the driving cam 200 is transmitted to the valve 300 through the driven cam 400. In this manner, since the CVVA system according various embodiments has a very simple configuration, it can be manufactured easily and inexpensively. Further, since the CVVA system according various embodiments employs only the driven cam 400 as the constituent part for transmitting the driving force of the driving cam 200, it can more stably transmit the driving force of the driving cam 200 and reduce a possibility of malfunction.

Here, the cam face 410 of the driven cam 400 includes two sections that slide on the upper end of the valve 300 to thereby press the valve 300 in a downward direction when the driven cam 400 is rotated, wherein the two sections are a high lift section H where the driven cam 400 allows the valve 300 to move more than a set distance when rotated around the rotational axle, i.e. one end, thereof, and a low lift section L where the driven cam 400 allows the valve 300 to move less than a set distance when rotated around the rotational axle, i.e. one end, thereof, as illustrated in FIG. 4.

Since the midpoint of the high lift section H is formed at a position farther from the rotational axle of the driven cam 400 than that of the low lift section L, i.e. since the midpoint of the high lift section H is located farther from the rotational axle of the driven cam 400 than that of the low lift section L, the valve 300 is farther lowered when the high lift section H of the cam face 410 pushes the upper end of the valve 300, as compared to when the low lift section L of the cam face 410 pushes the upper end of the valve 300. At this time, the high lift section H of the cam face 410 of the driven cam 400 comes into contact with the contact block 310 of the valve 300 when the hinge axle 510 as the rotational center of the driven cam 400 move upwards from the position illustrated in FIG. 3, whereas the low lift section L of the cam face 410 of the driven cam 400 comes into contact with the contact block 310 of the valve 300 when the hinge axle 510 as the rotational center of the driven cam 400 moves downwards from the position illustrated in FIG. 3.

The swing arm 500 of the CVVA system according to various embodiments is a constituent part for moving upwards or downwards the hinge axle 510 as the rotational center of the driven cam 400, and is configured so as to be rotated around one end thereof (the left-hand side of FIG. 3) hinged to a bracket 700. At this time, the other end of the swing arm 500 (the right-hand side of FIG. 3) is hinged to the one end of the driven cam 400 by the hinge axle 510. When the swing arm 500 is rotated around the one end thereof hinged to the bracket 700 in a counterclockwise direction from the position illustrated in FIG. 3, the hinge axle 510 as the rotational center of the driven cam 400 moves upwards, the high lift section H of the cam face 410 of the driven cam 400 comes into contact with the contact block 310 of the valve 300. In contrast, when the swing arm 500 is rotated around the one end thereof hinged to the bracket 700 in a clockwise direction from the position illustrated in FIG. 3, the hinge axle 510 as the rotational center of the driven cam 400 moves downwards, the low lift section L of the cam face 410 of the driven cam 400 comes into contact with the contact block 310 of the valve 300.

The CVVA system according to various embodiments may be configured so that the one end of the swing arm 500 is directly rotated by a driving means such as a motor controlled by an electronic control unit (ECU) of the vehicle. Further, as illustrated, the CVVA system may be additionally equipped with an actuating shaft 600 for rotating the swing arm 500.

The actuating shaft 600 is rotatably mounted below the swing arm 500, and includes a pressing nose 610, which protrudes so as to be contacted with a lower face of the other end of the swing arm 500. Thus, when the actuating shaft 600 is rotated in a clockwise direction from the position illustrated in FIG. 3, the pressing nose 610 pushes the lower face of the other end of the swing arm 500 in an upward direction, and thus raises the hinge axle 510. In contrast, when the actuating shaft 600 is rotated in a counterclockwise direction from the position illustrated in FIG. 3, the pressing nose 610 is lowered, and thus the other end of the swing arm 500 and the hinge axle 510 coupled to the other end of the swing arm 500 are lowered.

At this time, the pressing nose 610 is preferably formed so that a face contacted with the swing arm 500 may be curved so as to allow the other end of the swing arm 500 and the hinge axle 510 coupled to the other end of the swing arm 500 to continuously move upwards and downwards. Further, the actuating shaft 600 is preferably configured so that rotational direction and angle thereof is controlled by a driving means such as a motor controlled by an ECU of the vehicle.

When the driving cam 200 is configured to slide on any portion of the driven cam 400, the portion of the driven cam 400 which is in contact with the driving cam 200 may be worn away, thereby varying the rotational angle of the driven cam 400.

For this reason, the driven cam 400 is preferably provided with a roller 420 at the portion where it is in contact with the driving cam 200. In this case, when the driving cam 200 is rotated, the roller 420 installed on the driven cam 400 is rotated together, so that no abrasion occurs between the driving cam 200 and the driven cam 400, and thus the rotational angle of the driven cam 400 is kept constant.

Further, the cam face 410 has the shape of a downwardly curved surface such that the cam face 410 can continue to be in stable contact with the contact block 310 when the driven cam 400 is rotated. The valve 300 is preferably formed such that a portion thereof contacted with the cam face 410 has the shape of an upwardly curved surface. Although this embodiment shows only the structure in which the contact block 310 formed on the upper end of the valve 300 is in contact with the cam face 410, the valve 300 may be configured so that the upper end of a stem thereof can be in direct contact with the cam face 410 without the contact block 310.

Figure 5:
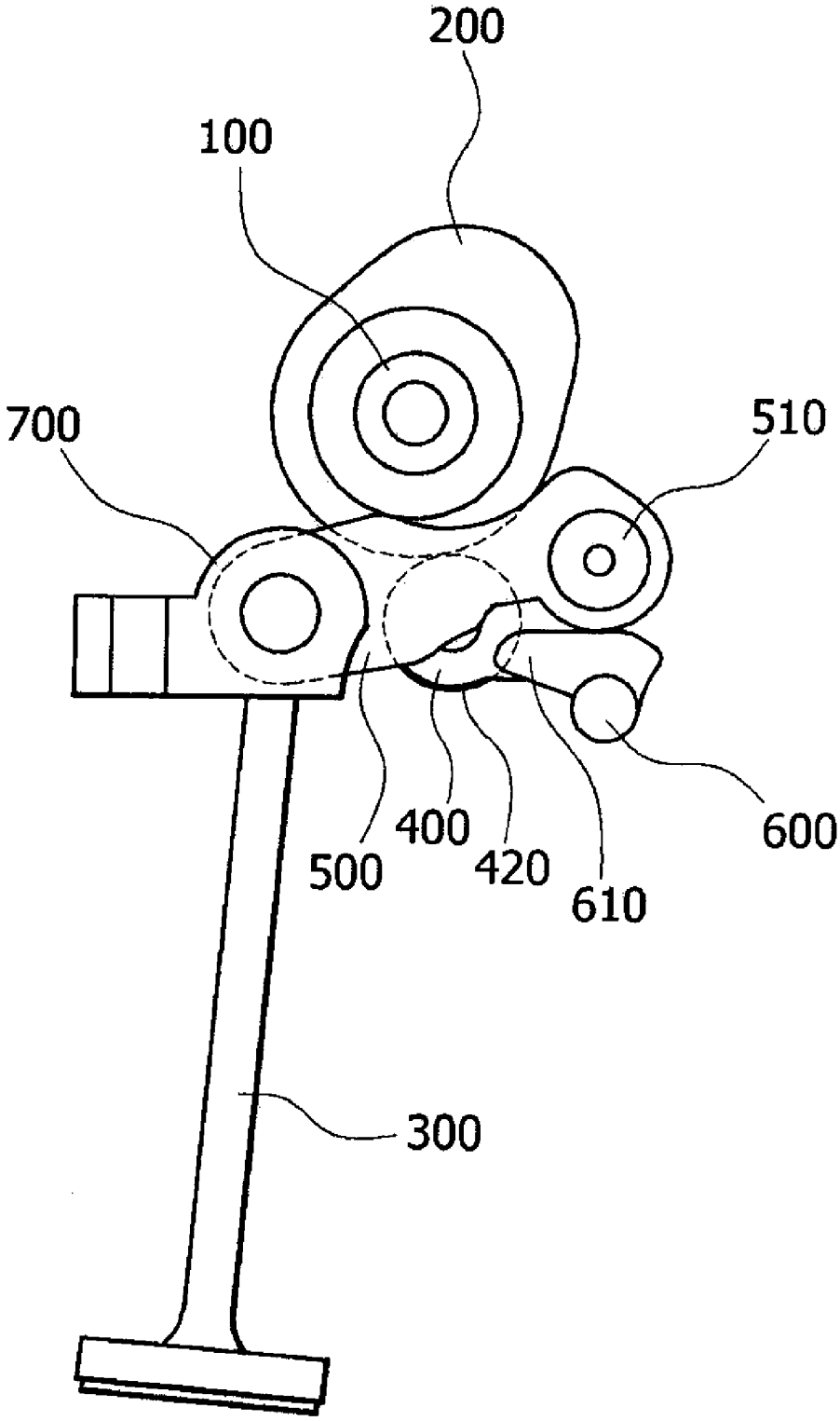
FIGS. 5 and 6 are side views illustrating low lift operation of an exemplary CVVA system according to the present invention.
Figure 6:
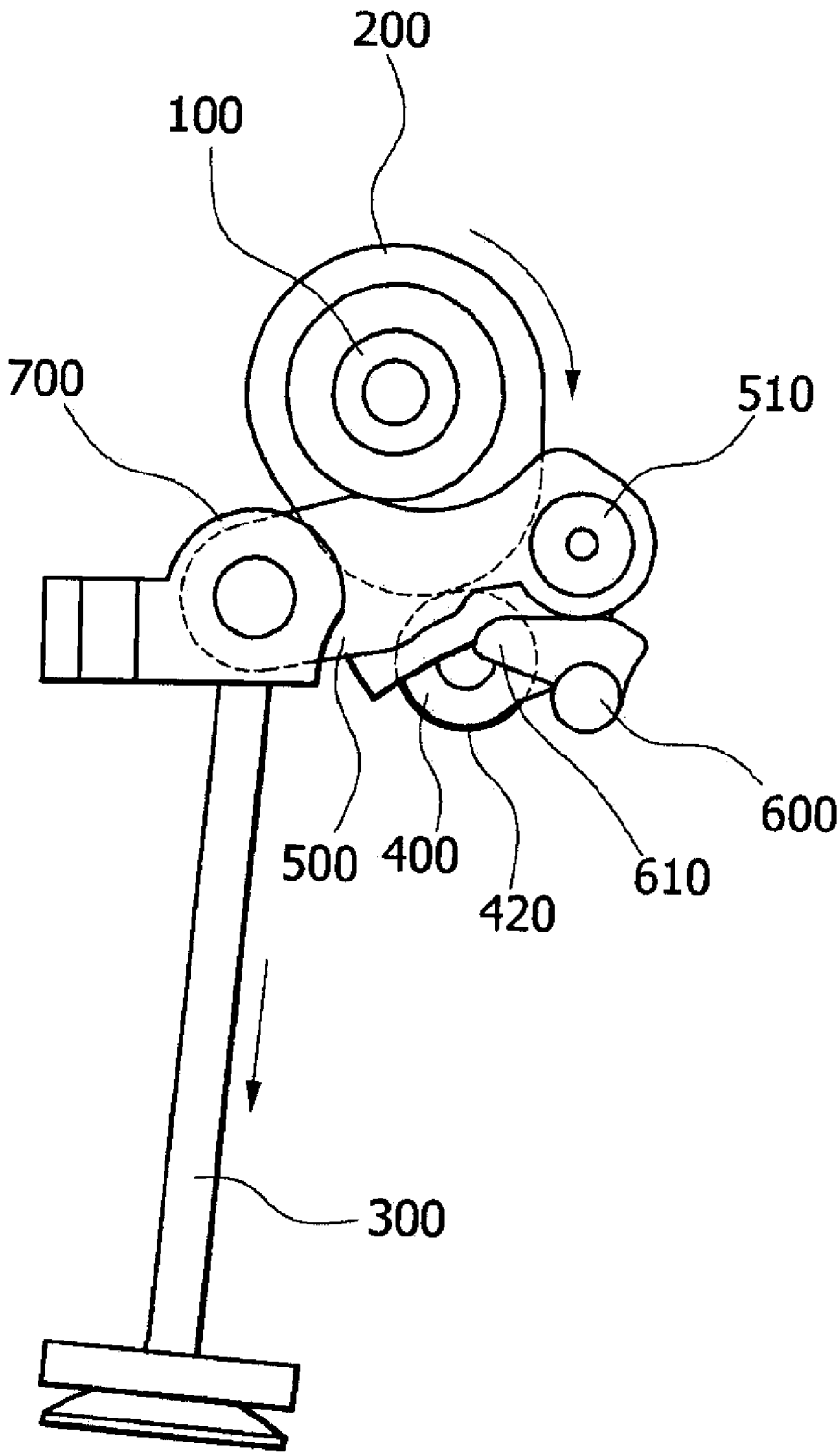
Figure 7:
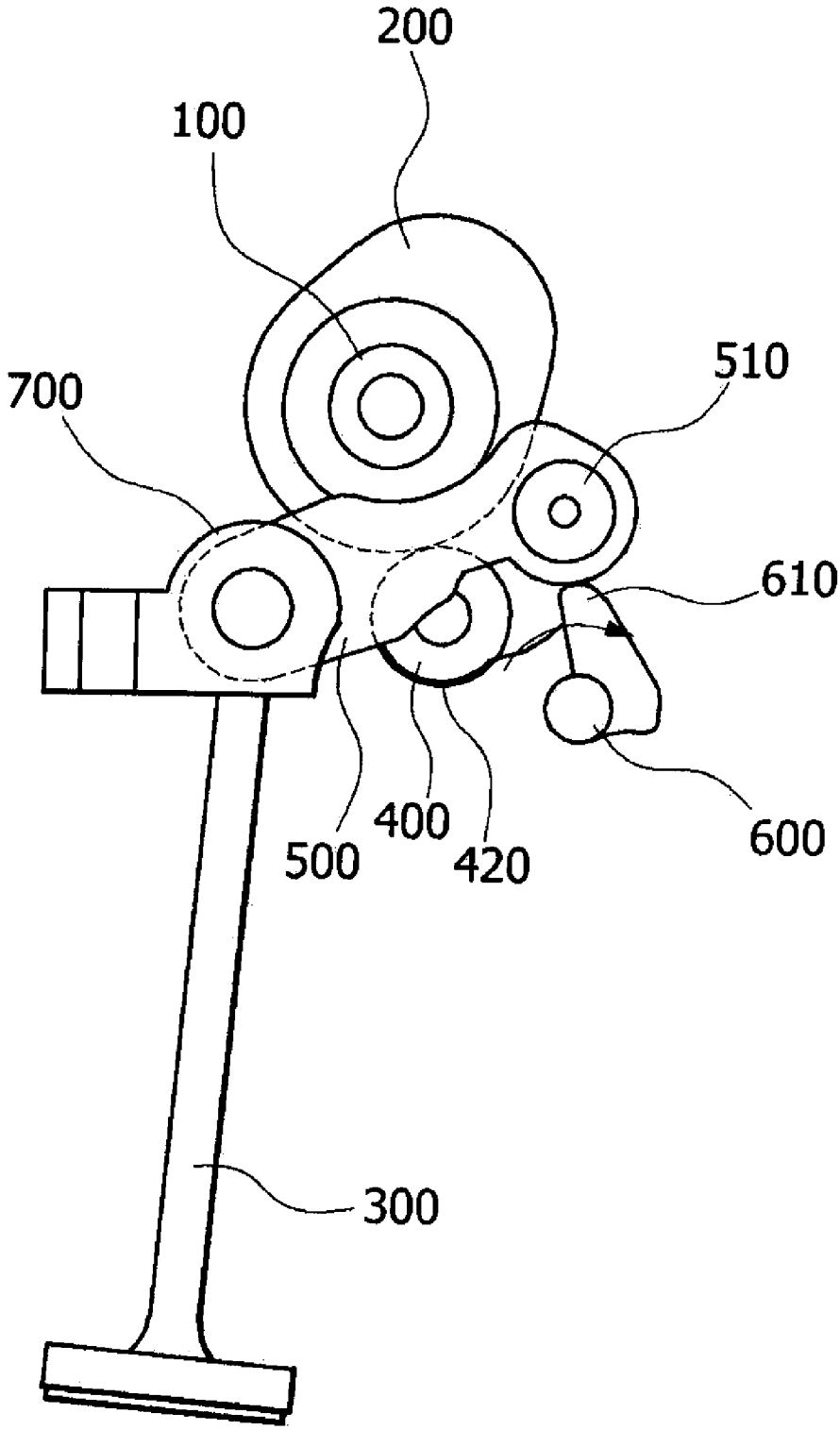
FIGS. 7 and 8 are side views illustrating high lift operation of an exemplary CVVA system according to the present invention.
Figure 8:
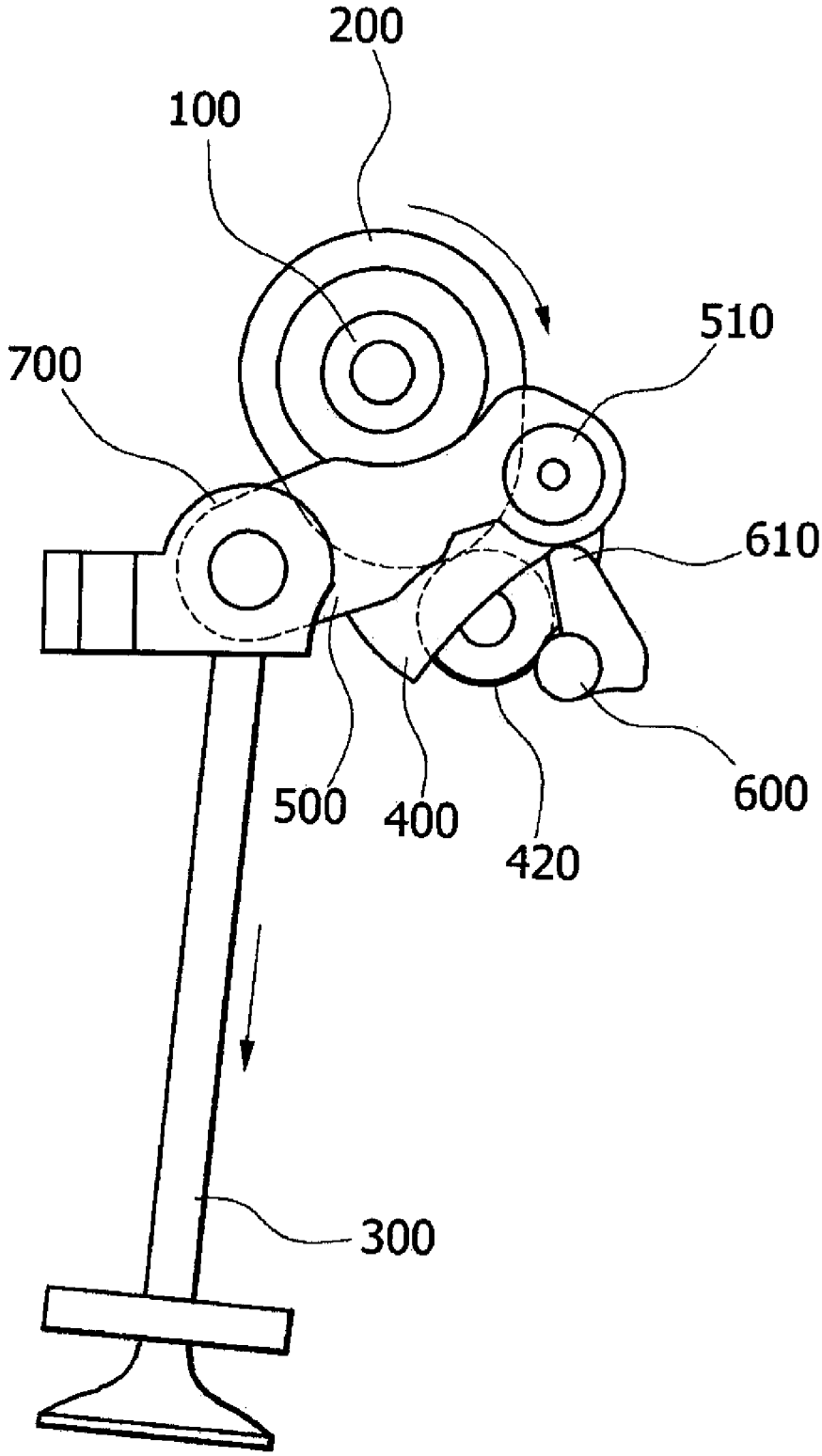

FIGS. 5 and 6 are side views illustrating low lift operation of a CVVA system according to various embodiments of the present invention, and FIGS. 7 and 8 are side views illustrating high lift operation of a CVVA system according to various embodiments of the present invention.

In the case in which a short lift distance of the valve 300 is required, the actuating shaft 600 is rotated in a counterclockwise direction from the position illustrated in FIG. 3, thereby lowering the hinge axle 510 as illustrated in FIG. 5. When the hinge axle 510 is lowered, the driven cam 400 coupled with the hinge axle 510 is also lowered. Thus, the contact block 310 of the valve 300 comes into contact with the low lift section L of the cam face 410 of the driven cam 400.

When the driving cam 200 is rotated from the position illustrated in FIG. 5, the lobe thereof comes into contact with the roller 420. Thereby, the driven cam 400 is rotated around the hinge axle 510 in a counterclockwise direction, and thus the cam face 410 of the driven cam 400 lowers the contact block 310 of the valve 300, so that the valve 300 is opened.

At this time, the cam face 410 of the driven cam 400 is adapted so that only the low lift section L thereof comes into contact with the contact block 310 regardless of the rotational angle of the driven cam 400. Thus, the valve 300 is no more lowered as compared to the state illustrated in FIG. 6.

In contrast, in the case in which a long lift distance of the valve 300 is required, the actuating shaft 600 is rotated in a clockwise direction from the position illustrated in FIG. 3, thereby raising the hinge axle 510 as illustrated in FIG. 7. When the hinge axle 510 is raised, the driven cam 400 coupled with the hinge axle 510 is also raised. Thus, the contact block 310 of the valve 300 comes into contact with the high lift section H of the cam face 410 of the driven cam 400. At this time, since the roller 420 of the driven cam 400 is also further raised as compared to the state illustrated in FIG. 5, the lobe of the driving cam 200 comes into contact with the roller 420 earlier when the driving cam 200 is rotated. When the driving cam 200 is rotated in a clockwise direction from the position illustrated in FIG. 7, the driven cam 400 is further rotated around the hinge axle 510 as compared to the state illustrated in FIG. 6, as illustrated in FIG. 8. In other words, the cam face 410 of the driven cam 400 is adapted so that only the high lift section H thereof comes into contact with the contact block 310, so that the valve 300 is further lowered as compared to the state illustrated in FIG. 6.

As described above, according to various embodiments of the present invention, the CVVA system can regulate the lift distance of the valve 300 by means of the rotation of the actuating shaft 600 or the rotation of the one end of the swing arm 500. Further, the CVVA system can regulate the lift time of the valve 300 earlier or later by means of appropriate modification in the profile of the cam face 410. This profile of the cam face 410 can be variously modified depending on a shape or a mounting position of each constituent part, and so a detailed description thereof will be omitted.

For convenience in explanation and accurate definition in the appended claims, the terms "upper", "lower," upwards, and "downwards" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A continuously variable valve actuation, comprising:

a driving cam firmly fixed to a crank shaft and rotated by a driving force of the crank shaft;

a driven cam including a roller directly mounted thereon contacting the driving cam and configured to rotatably contact the driving cam, wherein the driven cam is selectively pressed by the driving cam to rotate around one end thereof about a rotational axle, and wherein the driven cam has a cam face at an other end thereof so as to press and open a valve when pressed, wherein the roller on the driven cam pivots with respect to the one end of the driven cam as the roller is pressed by the driving cam; and a swing arm, one end of which is pivotally coupled to a stationary member and the other end of which is coupled to the one end of the driven cam to be rotated around the rotational axle of the swing arm.

2. The continuously variable valve actuation according to claim 1, wherein a contact portion between the driving cam and the driven cam is disposed between the one end and the other end of the swing arm.

3. The continuously variable valve actuation according to claim 1, wherein the one end of the swing arm is connected to a driving device so as to control a rotation angle of the swing arm with respect to the one end thereof.

4. The continuously variable valve actuation according to claim 1, wherein the cam face includes a high lift section where the driven cam allows the valve to move more than a set distance when rotated around the one end thereof, and a low lift section where the driven cam allows the valve to move less than a set distance when rotated around the one end thereof.

5. The continuously variable valve actuation according to claim 4, wherein the high lift section has a center formed at a position farther from the one end of the driven cam than a center of the low lift section.

6. The continuously variable valve actuation according to claim 1, further comprising an actuating shaft, which regulates a height of the one end of the driven cam such that the cam face contacted with the valve is limited between the high lift section and the low lift section regardless of a rotational angle of the driven cam.

7. The continuously variable valve actuation according to claim 6, wherein the actuating shaft includes a pressing nose, which is configured to be contacted with a lower face of the other end of the swing arm and rotates the other end of the swing arm by rotating the actuating shaft.

8. The continuously variable valve actuation according to claim 7, wherein the pressing nose is downwardly curved.

9. The continuously variable valve actuation according to claim 1, wherein the stationary member is a bracket, which rotatably supports the one end of the swing arm.

10. The continuously variable valve actuation according to claim 1, wherein the cam face has a shape of a downwardly curved surface, and the valve has a shape of an upwardly curved surface at a portion contacting the cam face.

11. The continuously variable valve actuation according to claim 1, wherein the driving can and the driven cam are disposed between the one end and the other end of the swing arm.

* * * * *